US005332515A

United States Patent [19]

Tomizawa et al.

[11] Patent Number: 5,332,515

[45] Date of Patent: Jul. 26, 1994

[54] FLUID FOR VISCOUS COUPLING

[75] Inventors: Hirotaka Tomizawa; Noboru Umemoto; Hitoshi Ohenoki, all of Ooi, Japan

[73] Assignee: Tonen Corporation, Tokyo, Japan

[21] Appl. No.: 984,731

[22] Filed: Dec. 4, 1992

Related U.S. Application Data

[63] Continuation-in-part of Ser. No. 520,926, May 9, 1990, abandoned.

[30] Foreign Application Priority Data

| | | | |
|---|---|---|---|
| May 10, 1989 | [JP] | Japan | 1-116265 |
| Nov. 30, 1989 | [JP] | Japan | 1-312700 |
| Feb. 7, 1990 | [JP] | Japan | 2-28700 |
| Feb. 9, 1990 | [JP] | Japan | 2-30990 |
| Feb. 13, 1990 | [JP] | Japan | 2-33368 |

[51] Int. Cl.[5] ..... C10M 105/76

[52] U.S. Cl. ..... 252/49.6; 252/49.9; 252/78.3

[58] Field of Search ..... 252/32.7 E, 78.3, 49.6, 252/49.9

[56] References Cited

U.S. PATENT DOCUMENTS

| | | | |
|---|---|---|---|
| 4,048,083 | 9/1977 | Knollmueller | 252/78.3 |
| 4,051,053 | 9/1977 | Scotchford et al. | 252/78.3 |
| 4,097,393 | 6/1978 | Cupper et al. | 252/78.3 |
| 4,244,831 | 1/1981 | Cupper | 252/78.3 |
| 4,744,915 | 5/1988 | Budnik | 252/78.3 |

FOREIGN PATENT DOCUMENTS 2206887A 1/1989 United Kingdom .

OTHER PUBLICATIONS

"Lubrication Theory and Practice" by Dr. P. A. Asseff; published by The Lubryol Corporation; pages (date unknown).

*Primary Examiner*—Jacqueline V. Howard
*Attorney, Agent, or Firm*—Armstrong, Westerman, Hattori, McLeland & Naughton

[57] ABSTRACT

In the fluid for viscous coupling according to the present invention, organopolysiloxane is used as base oil, and by adding phosphorus type anti-wear agent or by adding the combination of said phosphorus type anti-wear agent with antioxidant or by adding the combination of phosphorus type anti-wear agent with sulfur type anti-wear agent and/or zinc dithiophosphate type anti-wear agent or further by adding antioxidant, it is possible to increase heat-resistant property without changing the viscosity when viscous coupling is in operation and to provide the fluid for viscous coupling with few wear fragment iron quantity and with high durability.

In the fluid for viscous coupling according to this invention, organopolysiloxane is used as base oil, and by adding metal deactivator and/or corrosion inhibitor, or by adding anti-wear agent and/or antioxidant, it is possible to prevent the viscosity change for long time when viscous coupling is in operation and to provide the fluid for viscous coupling with high durability.

7 Claims, No Drawings

FLUID FOR VISCOUS COUPLING

This application is a continuation-in-part of application Ser. No. 07/520,926 filed May 9, 1990, now abandoned.

BACKGROUND OF THE INVENTION

The present invention relates to a fluid for viscous coupling with high durability.

In recent years, organopolysiloxane oil such as dimethylpolysiloxane, methylphenylpolysiloxane, etc. have been used as the hydraulic fluid or the operating fluid for fluid coupling (also called "viscous coupling" (VC)), and the operating conditions are becoming increasingly severe.

In a viscous coupling (VC), a plurality of inner plates movably disposed on the driving shaft and a plurality of outer plates fixed on the driven shaft with predetermined spacings are combined together alternately and are accommodated in a housing, and dimethylpolysiloxane oil, which is a viscous fluid for torque transmission, is filled in it. Under such arrangement, shearing force, i.e. shear torque, is generated in said plate groups by the difference of the revolutions between the driving shaft and the driven shaft in order to transmit torque to the driven shaft.

As the fluid coupling (viscous coupling) of this type, dimethylpolysiloxane (also called dimethyl-silicone oil) with high viscosity index (VI) is used, but it is difficult to maintain stable torque transmission ability for a long time under severe operating conditions at high temperature. This is mainly due to the low thermal stability of dimethyl-silicone oil at high temperature. Because the operating conditions are becoming increasingly severe in various applications including the application of viscous coupling, it is an imminent problem to improve thermal stability of silicone oil, which constitutes the main component of dimethyl-silicone.

To prevent oxidation or gelation, antioxidants such as iron octanoate, phenylamine derivatives, ferrocene derivatives, etc. have been added to organopolysiloxane oil.

Although a certain level of the gelation preventive effect can be obtained at high temperature when these antioxidants are added, the viscosity increases when viscous coupling is continuously used.

The object of this invention is to offer a fluid for viscous coupling, which provides excellent effect for the prevention of thermal decomposition and gelation and is furnished with high stability.

SUMMARY OF THE INVENTION

First, the fluid for viscous coupling according to the present invention is characterized in that organopolysiloxane is adopted as base oil and a phosphorus type anti-wear agent is added to it.

In the conventional type fluid for viscous coupling, the quality of antioxidants has been improved in order to prevent the thickening effect by thermal deterioration caused during the operation at high temperature. When antioxidant is added to the fluid for viscous coupling and it is actually applied on viscous coupling, viscosity is still increased.

The present inventors have considered that this problem cannot be solved simply by the improvement of the effect of antioxidants and have found that the metallic contact between disks of viscous coupling exerts a very strong influence. Namely, it appears that the fresh metal surface of the metal disk caused by metallic contact acts as a catalyst to the deterioration of organopolysiloxane and enhances the deterioration of the fluid for viscous coupling.

By adding anti-wear agent to the fluid for viscous coupling, film is formed on the fresh metal surface of metal and the catalytic effect is thus prevented. This contributes to the elimination of the thickening phenomenon of the fluid for viscous coupling.

By the fluid for viscous coupling according to the present invention, it is possible to increase the heat-resistant property of the fluid for viscous coupling and to improve its durability by adding antioxidants together with the anti-wear agent.

Secondly, the fluid for viscous coupling of this invention is characterized in that organopolysiloxane is used as base oil a phosphorus type anti-wear agent and a sulfur type anti-wear agent and/or a zinc dithiophosphate type anti-wear agent are added to it.

Phosphorus type anti-wear agent, sulfur type anti-wear agent, zinc dithiophosphate type anti-wear agent, etc. have a certain effect when each of them is added alone to the fluid for viscous coupling. According to this invention, however, phosphorus type anti-wear agent, sulfur type anti-wear agent and/or zinc dithiophosphate anti-wear agent are combined and blended together, and this gives a cumulative effect to form film on the newly appeared metal surface and to suppress catalytic action by the new metal surface, thus almost completely eliminating the thickening phenomenon of the fluid for viscous coupling. This provides the better effect compared with the case where phosphorus type anti-wear agent is used alone.

The anti-wear agents such as phosphorus type, sulfur type, zinc dithiophosphate type, etc. give an adsorption effect on the metal in a specific temperature range according to thermal stability of each substance. It appears that various friction and wear conditions occur in the viscous coupling itself during the operation and that the environmental temperature also widely differs. According to this invention, the anti-wear agents with different adsorption property are combined to cope with such conditions.

By adding antioxidant to the fluid for viscous coupling in addition to these anti-wear agents, it is possible to increase the heat-resistant property and to improve the durability of the fluid for viscous coupling.

Thirdly, the fluid for viscous coupling of this invention is characterized in that organopolysiloxane is used as a base oil and metal a deactivator and/or a corrosion inhibitor is added.

Although metal deactivator and/or corrosion inhibitor has lower solubility to the fluid for viscous coupling than the anti-wear agent, these substances can prevent the increase of viscosity of the fluid for viscous coupling when they are added in small quantity. This increases further the heat resistant property and improve the durability of the fluid for viscous coupling.

When an anti-wear agent and/or antioxidants is added to the fluid for viscous coupling, it is possible to increase the heat-resistant property and to improve the durability of the fluid for viscous coupling.

DESCRIPTION OF THE PREFERRED EMBODIMENT

Organopolysiloxane, which is the base oil of the fluid for viscous coupling according to this invention, has the following formula:

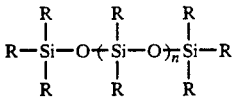

(In the formula, R is the same or different, or sometimes the halogenated hydrocarbon group having 1–18 carbon atoms, and n represents an integral number of 1–3000 preferably 130–1,500, more preferably 140–1,400.) The viscosity of the organopolysiloxane ranges from 1,000 to 500,000 $mm^2/s$ (25° C.).

R is an alkyl group such as methyl group, ethyl group, n-propyl group, i-propyl group, n-butyl group, i-butyl group, t-butyl group, n-pentyl group, neopentyl group, hexyl group, heptyl group, octyl group, decyl group and octadecyl group, an allyl group such as phenyl group or naphthyl group, a aralkyl group such as benzyl group 1-phenylethyl group, 2-phenylethyl group, an alallyl group such as o-, m-p-diphenyl group, or a halogenated hydrocarbon group such as o-, m-, p-chlorphenyl group, o-, m-, p-bromphenyl group, 3,3,3-trifluorpropyl group, 1,1,1,3,3,3-hexafluor-2-propyl group, heptafluorisopropyl group and heptafluornpropyl group. Particularly, it is preferable to use a fluorinated hydrocarbon group having 1–8 carbon atoms except an aliphatic unsaturated group as R. Or, the mixture of methylpolysiloxane and phenylpolysiloxane may be used.

The first feature of this invention is that a phosphorus type anti-wear agent is added to organopolysiloxane as an anti-wear agent.

As the phosphorus type anti-wear agent, a compound is effective, which has at least one of the following structures (1)–(27) as general formula. In the following formulae, R may refer to hydrogen, alkyl group, aryl group or benzyl group. R may be the same or different.

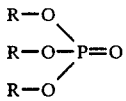
(1)

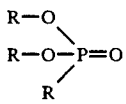
(2)

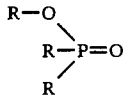
(3)

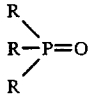
(4)

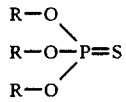
(5)

-continued

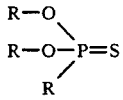
(6)

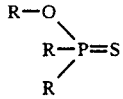
(7)

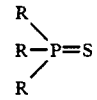
(8)

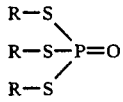
(9)

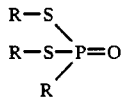
(10)

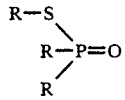
(11)

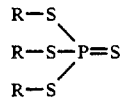
(12)

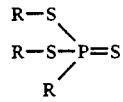
(13)

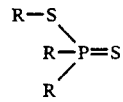
(14)

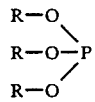
(15)

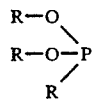
(16)

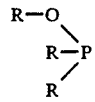
(17)

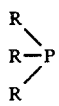
(18)

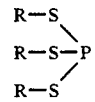
(19)

-continued (20)

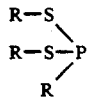

(21)

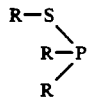

(22)

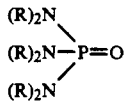

(23)

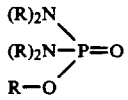

(24)

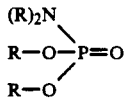

(25)

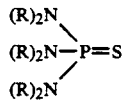

(26)

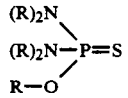

(27)

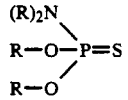

In the following, actual compounds are given:

As the compound having the above structural formula (1), there are triaryl phosphate and the like. For example, phosphate such as benzyldiphenyl phosphate, allyldiphenylphosphate, triphenyl phosphate, tricresyl phospahte, ethyldiphenyl phosphate, tributyl phosphate, dibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, propyl phenyl phenyl phosphate mixture, butyl phenyl phenyl phosphate mixure, etc., or acid phosphate such as lauryl acid phosphate, stearyl acid phosphate, di-2-ethylhexyl phosphate, etc.

As the compound represented by the structural formula (2), there is, for example, di-n-butylhexyl phosphate, etc.

As the compound represented by the structural formula (3), there is, for example, n-butyl-n-dioctyl phosphinate, etc.

As the compound represented by the structural formula (5), there are triaryl phosphoro-thionate and the like. For example, triphenyl phosphoro-thionate and alkylaryl phosphorothionate, etc.

As the compound represented by the structural formula (15), there are, for example, triisopropyl phosphite and diisopropyl phosphite, etc.

As the compound represented by the structural formula (19), there is, for example, trilauryl thiophosphite, etc.

As the compound represented by the structural formula (22), there is, for example, hexamethyl phosphoric triamide, etc.

As the compound represented by the structural formula (24), there is, for example, dibutyl phosphoroamidate, etc.

Among these compounds, the effects are particularly conspicuous in the cases of the compounds with excellent thermal stability having the structure of triaryl phosphate or triaryl phosphoro-thionate.

It is preferable to use the phosphorus type anti-wear agent in the amount of 0.01–5 wt % to organopolysiloxane, and more preferably, 0.1–3 wt %. The above phosphorus type anti-wear agent may be used alone or in combination of two or more compounds.

The second feature of this invention is that, in addition to the phosphorus type anti-wear agent, a sulfur type anti-wear agent and/or zinc dithiophosphate type anti-wear agent is combined and added.

As the sulfur type anti-wear agent, the sulfides such as diphenylsulfide, diphenyl disulfide, dibenzyl disulfide, di-n-butyl sulfide, di-n-butyl disulfide, di-tert-butyl disulfide, di-tert-dodecyl sulfide, di-tert-dodecyl trisulfide, etc., the sulfurized oil such as sulfurized sperm oil, sulfurized dipentene, etc., or the thiocarbonates such as xanthic disulfide, etc. and zinc dithiophosphate anti-wear agent such as primary alkyl zinc dithiophosphate, secondary alkyl zinc dithiophosphate, alkyl-aryl zinc dithiophosphate, aryl zinc dithiophosphate, etc. can be used. It is preferable to use all anti-wear agents including phosphorus type anti-wear agents and sulfur type anti-wear agent and/or zinc dithiophosphate anti-wear agents to organopolysiloxane in an amount of from 0.01–5 wt %, and more preferably, in an amount of from 0.1–3 wt %. The ratio to use phosphorus type anti-wear agent to total anti-wear agents is preferably 5–95 wt %.

Instead of combining and adding phosphorus type anti-wear agent and sulfur type anti-wear agent, the compound having at least one of the following formulae such as

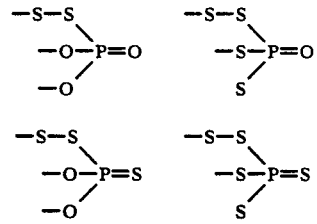

as general formula, e.g. the compounds such as benzyl (di-n-pentyl phosphoryl) bisulfide, etc. may be used.

It is preferable to use the compound in an amount of from 0.01–5 wt % to organopolysiloxane, and more preferably, in an amount of from 0.1–3 wt %.

Further, the third feature of the fluid for viscous coupling of this invention is that metal deactivator and/or corrosion inhibitor is added to organopolysiloxane alone or together with the above anti-wear agents.

As the metal deactivator, benzotriazole, benzothiazole derivatives, thiadiazole, thiadiazole derivatives, triazole, triazole derivatives, dithiocarbamate, dithiocarbamate derivatives, indazole, indazole derivatives, etc. or organic carboxylic acids including dibasic acids such as adipic acid, sebacic acid, dodecane dioic acid, etc. or monobasic acids such as stearic acid, oleic acid, lauric acid, etc. or amine salts of these compounds may be used.

It is preferable to use metal deactivator in an amount of from 0.001–1.0 wt % to organopolysiloxane, and more preferably, in an amount of from 0.01–0.5 wt %. If the added quantity exceeds 1.0 wt %, precipitation increases, and this is not very desirable. If it is less than 0.001 wt %, there is no effect.

As the corrosion inhibitors, there are isostearate, n-octadecylammonium stearate, DUOMEEN-T diorate, lead naphthenate, sorbitan oleate, pentaerythrite oleate, oleyl sarcosine, alkyl succinic acid, alkenyl succinic acid, and the derivatives of these compounds. It is preferable to use these compounds in an amount of from 0.001–1.0 wt % to organopolysiloxane, and more preferably, in amount of from 0.01–0.5 wt %. When the added quantity exceeds 1.0 wt %, it is not desirable because precipitation increases. If it is less than 0.001 wt %, there is no effect.

In the fluid for viscous coupling according to the present invention, the durability can be increased by adding antioxidant in case the above phosphorus anti-wear agent is added alone, or in case phosphorus type anti-wear agent and sulfur type anti-wear agent and/or zinc dithiophosphate type anti-wear agent are combined and added, and further in case metal deactivator and/or corrosion inhibitor is added alone or together with the above anti-wear agents.

As the antioxidants, amine type antioxidants such as dioctyldiphenylamine, phenyl-α-naphthylamine, alkyldiphenylamine, N-nitrosodiphenylamine, phenothiazine, N,N'-dinaphthyl-p-phenylenediamine, acridine, N-methylphenothiazine, N-ethylphenothiazine, dipyrizylamine, diphenylamine, etc., the phenol type antioxidants such as 2,6-di-t-butylparacresol, 4,4'-methylenebis (2,6-di-t-butylphenol), 2,6-di-t-butylphenol, etc., or the organic metal compound type antioxidants such as organic iron salt including iron octoate, ferrocene, iron naphthoate, etc., organic cerium salt including cerium naphthoate, cerium toluate, etc. and organic zirconium salt including zirconium octoate, etc. may be used. The above antioxidants may be used alone or in combination of two or more compounds to provide cumulative effects.

It is preferable to use the above antioxidants in an amount of from 0.001–5 wt % to organopolysiloxane, and more preferably, in an amount of from 0.01–2 wt %.

In the following, the present invention will be described in detail in connection with the embodiments, while the invention is not limited to these embodiments.

EXAMPLE 1

To dimethylsilicone (viscosity 50000 $mm^2/s$, 25° C.), diphenylamine was added in an amount of from 1.0 wt %, and tricresyl phosphate was added by the ratio shown below as the phosphorus type anti-wear agent. The fluid for viscous coupling thus prepared was filled into a viscous coupling having 111 disks at 25° C. and with the filling degree of 85 vol %. The rotating speed difference was 50 rpm.

The viscous coupling was placed in a bath kept at constant temperature of 130° C. and was operated for 50 hours.

After the operation, viscosity change and torque change were measured. The results are given in the table below. In the table, the results of the case where phosphorus type anti-wear agent was not added are also shown.

To evaluate the heat-resistant property of anti-wear agent a, hot tube coking test was performed, and the temperature, at which the specimen was gelated or blocked by coking the glass tube, was measured at every 10° C. The lowest temperature is also shown in the table below.

| Added quantity of anti-wear agent (wt %) | Viscosity change (%) | Torque change (%) | Blocking temperature (°C.) |
|---|---|---|---|
| 2.0 | −5 | −5 | 330 |
| 1.0 | +1 | 0 | 330 |
| 0.5 | +5 | +5 | 330 |
| 0 | Measurement not achievable | Measurement not achievable* | 330 |

*Stopped before the expiration of 50 hours due to sudden increase of torque.

In this example, the fluid for viscous coupling was prepared without adding antioxidant, and viscosity change and torque change were measured. The results are given in the table below.

| Added quantity of anti-wear agent (wt %) | Viscosity change (%) | Torque change (%) | Blocking temperature (°C.) |
|---|---|---|---|
| 2.0 | −3 | −3 | 290 |
| 1.0 | +1 | +1 | 290 |
| 0.5 | +6 | +5 | 290 |
| 0 | Measurement not achievable | Measurement not achievable | 290 |

From this table, it is evident that the fluid for viscous coupling similar to the above can be prepared even when antioxidant is not added.

EXAMPLE 2

To dimethylsilicone (viscosity 50000 $mm^2/s$, 25° C.), diphenylamine was added as antioxidant by 1.0 wt %, and tricresyl phosphate (A) and triphenyl phosphorothionate (B) were added as phosphorus type anti-wear agents by the percentage as shown below (wt %). The fluid for viscous coupling thus prepared was tested by the same procedure as in the example 1. The results are given in the table below together with the results of the hot tube coking test.

| A Added quantity | B Added quantity | Viscosity change (%) | Torque change (%) | Blocking temperature (°C.) |
|---|---|---|---|---|
| 0 | 1.0 | +2 | +1 | 330 |
| 0.5 | 0.5 | +1 | 0 | 330 |

In this example, the fluid for viscous coupling was prepared without adding antioxidant, and viscosity change and torque change were measured by the same procedure. The results are given in the table below together with the results of the hot tube coking test.

| A Added quantity | B Added quantity | Viscosity change (%) | Torque change (%) | Blocking temperature (°C.) |
|---|---|---|---|---|
| 0 | 1.0 | +1 | +1 | 290 |
| 0.5 | 0.5 | +3 | +3 | 290 |

From this table, it is evident that the fluid for viscous coupling similar to the above can be prepared even when antioxidant is not added.

COMPARATIVE EXAMPLE 1

To dimethylsilicone (viscosity 50000 $mm^2/s$, 25° C.), diphenylamine was added as antioxidant by 1.0 wt % and dibenzyl disulfide was added as the sulfur type anti-wear agent by the percentage as shown below. The fluid for viscous coupling thus prepared was tested by the same procedure as in the Embodiment 1. The results are shown in the table below. The results of the hot tube coking test are also shown as in the case of Embodiment 1.

| Added quantity of anti-wear agent (wt %) | Viscosity change (%) | Torque change (%) | Blocking temperature (°C.) |
|---|---|---|---|
| 1.0 | −2 | −2 | 300* |
| 0.5 | +5 | +7 | 310* |
| 0 | Measurement not achievable | Measurement not achievable | 320 |

*Accompanied with coking.

In this comparative example, the fluid for viscous coupling was also prepared without adding antioxidant, and viscosity change and torque change were measured by the same procedure. The results are given in the table below together with the results of the hot tube coking test.

| Added quantity of anti-wear agent (wt %) | Viscosity change (%) | Torque change (%) | Blocking temperature (°C.) |
|---|---|---|---|
| 2.0 | −3 | −4 | 250* |
| 1.0 | +1 | 0 | 250* |
| 0.5 | +7 | +7 | 260* |
| 0 | Measurement not achievable | Measurement not achievable | 290 |

*Accompanied with coking.

As it is evident from this comparative example, both sulfur type and phosphorus type have almost the same torque stability as the anti-wear agents to be added to the fluid for viscous coupling. However, because the heat-resistant property of the additive itself is inferior to that of organopolysiloxane, used as base oil, the coking phenomenon occurs, in which black decomposed product of additive is generated in the hot tube coking test, and the thermal stability of the fluid for viscous coupling is reduced by the addition of anti-wear agent.

EXAMPLE 3

To dimethylsilicone (viscosity 100,000$mm^2/s$, 25° C.), tricresyl phosphate was added as the phosphorus type anti-wear agent by the percentage as given below. The fluid for viscous coupling thus prepared was filled into a viscous coupling having 111 disks at 25° C. and with the filling degree of 85 vol %. The rotating speed difference was 25 rpm. The viscous coupling was placed in a bath kept at constant temperature of 170° C. and was operated for 50 hours.

After the operation, viscosity change and torque change were measured. The results are shown in the table below. In the table, the results of the case where anti-wear agent was not added are also shown.

| Added quantity of anti-wear agent (wt %) | Viscosity change (%) | Torque change (%) |
|---|---|---|
| 2.0 | −6 | −7 |
| 1.0 | −3 | −3 |
| 0.5 | 0 | −1 |
| 0 | Measurement not achievable | Measurement not achievable |

EXAMPLE 4

In the example 3, triphenyl phosphate was added by the percentage as given below instead of the phosphorus type anti-wear agent tricresyl phosphate. The fluid for viscous coupling thus prepared was tested by the same procedure as in the example 3. The results are shown in the table below.

| Added quantity of anti-wear agent (wt %) | Viscosity change (%) | Torque change (%) |
|---|---|---|
| 2.0 | −5 | −5 |
| 1.0 | 0 | 0 |
| 0.5 | +2 | +1 |

EXAMPLE 5

In the example 3, triphenyl phosphorothiohate was added by the percentage as given below instead of the phosphorus type anti-wear agent tricresyl phosphate. The fluid for viscous coupling thus prepared was tested by the same procedure as in the example 3. The results are shown in the table below.

| Added quantity of anti-wear agent (wt %) | Viscosity change (%) | Torque change (%) |
|---|---|---|
| 2.0 | −7 | −7 |
| 1.0 | −5 | −3 |
| 0.5 | 0 | +1 |

COMPARATIVE EXAMPLE 2

In the example 3, dibenzyl disulfide was added by the percentage as given below as the sulfur type anti-wear agent instead of phosphorus type anti-wear agent of tricresyl phosphate. The fluid for viscous coupling thus prepared was tested by the same procedure as in the example 3. The results are shown in the table below.

| Added quantity of anti-wear agent (wt %) | Viscosity change (%) | Torque change (%) |
|---|---|---|
| 2.0 | −20 | −35 |
| 1.0 | −10 | −22 |
| 0.5 | −8 | −17 |
| 0 | Measurement not achievable | Measurement not achievable |

COMPARATIVE EXAMPLE 3

In the example 3, sulfur type anti-wear agent polysulfide was added by the percentage as given below instead of the phosphorus type anti-wear agent tricresyl phosphate. The fluid for viscous coupling thus prepared was tested by the same procedure as in the example 3. The results are shown in the table below.

| Added quantity of anti-wear agent (wt %) | Viscosity change (%) | Torque change (%) |
|---|---|---|
| 2.0 | −22 | −25 |
| 1.0 | −15 | −20 |
| 0.5 | −10 | −12 |

As it is evident from this comparative example, both phosphorus type and sulfur type exhibit excellent durability in viscosity change and torque change of the fluid for viscous coupling when temperature is relatively low as in the example 1 and 2 and in the comparative example 1, whereas phosphorus type shows the higher durability at high temperature.

This is attributable to the fact that, because the sulfur type anti-wear agent has a lower heat-resistant property, the reaction with dimethylsilicone or with the plates in viscous coupling proceeded excessively at high temperature, while the phosphorus type anti-wear agent has a higher heat-resistant property.

As for the odor of the fluid for viscous coupling, the fluid for viscous coupling as prepared in the example 3 is odorless and does not have the strong sulfur odor as the fluid prepared in the comparative example. If we consider the working environment of the workers, the phosphorus type anti-wear agent is more advantageous than the sulfur type anti-wear agent.

EXAMPLE 6

To dimethylsilicone (viscosity 50,000 $mm^2/s$, 25° C.), triphenyl phosphate was added as the phosphorus type anti-wear agent by the percentage as given below. The fluid for viscous coupling thus prepared was filled into an autoclave at 25° C. with the filling degree of 80 vol %. After substituting with nitrogen, it was placed at 200° C. in a thermostat for 24 hours. After the test, viscosity change was measured, and the results are shown in the table below.

| Added quantity of anti-wear agent (wt %) | Viscosity change (%) |
|---|---|
| 2.0 | −1 |
| 1.0 | ±0 |

In the example 6, sulfur type dibenzyl disulfide was added by the percentage given below instead of the phosphorus type anti-wear agent triphenyl phosphate. The fluid for viscous coupling thus prepared was tested by the same procedure as in the example 6. The results are shown in the table below.

| Added quantity of anti-wear agent (wt %) | Viscosity change (%) |
|---|---|
| 2.0 | −27 |
| 1.0 | −18 |

In the example 6, polysulfide was added as sulfur type anti-wear agent by the percentage given below instead of the phosphorus type anti-wear agent triphenyl phosphate. The fluid for viscous coupling thus prepared was tested by the same procedure as in the example 6. The results are shown in the table below.

| Added quantity of anti-wear agent (wt %) | Viscosity change (%) |
|---|---|
| 2.0 | −17 |
| 1.0 | −12 |

In the above example 6 and in the comparative examples 4–5, the sulfur type anti-wear agent having the lower heat-resistant property was deteriorated, and this apparently induced the viscosity decrease and the deterioration of dimethylsilicone.

In contrast, phosphorus type anti-wear agent was stable to dimethylsilicone as seen in the example 6, and this may be attributed to the high heat-resistant property of the phosphorus type anti-wear agent.

To dimethylsilicone (viscosity 100,000 $mm^2/s$, 25° C.), diphenylamine was added as antioxidant in an amount of 1.0 wt %, and tricresyl phosphate (phosphorus type) and dibenzyl disulfide (sulfur type) were added by the percentage given below as anti-wear agents. The fluid for viscous coupling thus prepared was filled into a viscous coupling having 111 disks at 25° C. and with the filling degree of 85 vol %. The rotating speed difference was 35 rpm.

The viscous coupling was maintained in a bath kept at constant temperature of 130° C. and was operated for 100 hours.

After the operation, viscosity change and torque change were measured. The results are given in the table below together with the results of the iron quantity, measured as wear fragment quantity. In the table, the results of the case where the anti-wear agents were separately added are also shown as the comparative example.

| Added quantity of phosphorus type (wt %) | Added quantity of sulfur type (wt %) | Viscosity change (%) | Torque change (%) | Wear fragment iron (ppm) |
|---|---|---|---|---|
| 0.5 | 0 | +5 | +5 | 450 |
| 0 | 0.5 | +7 | +5 | 480 |
| 0.25 | 0.25 | +1 | 0 | 120 |

As it is evident from the above table, the effects such as viscosity change and torque change as well as wear fragment iron are increased more in the case where two anti-wear agents are simultaneously added to the fluid for viscous coupling than the case where only one of the anti-wear agents is added.

In the fluid for viscous coupling in this embodiment, the fluid for viscous coupling was prepared without adding antioxidant, and viscosity change, torque change and wear fragment quantity were determined. The results are shown in the table below. In the table, the results of the case where anti-wear agents were separately added are also shown as the comparative example.

| Added quantity of phosphorus type (wt %) | Added quantity of sulfur type (wt %) | Viscosity change (%) | Torque change (%) | Wear fragment iron (ppm) |
|---|---|---|---|---|
| 0.5 | 0 | +5 | +5 | 470 |
| 0 | 0.5 | +5 | +5 | 430 |

-continued

| Added quantity of phosphorus type (wt %) | Added quantity of sulfur type (wt %) | Viscosity change (%) | Torque change (%) | Wear fragment iron (ppm) |
|---|---|---|---|---|
| 0.25 | 0.25 | +1 | +1 | 130 |

As it is evident from the above table, similar fluid for viscous coupling can be obtained even when antioxidant is not added.

In the fluid for viscous coupling, to which both of the above phosphorus type and sulfur type anti-wear agents were added, di-sec-butyl zinc dithiophosphate (zinc dithiophosphate type) was added by 0.20 wt %. The fluid for the viscous coupling thus prepared was tested by the same procedure as above. As the result, viscosity change was +1%, torque change was 0%, and wear fragment iron quantity was 140 ppm. Thus, it is apparent that excellent fluid for viscous coupling can be obtained by combining phosphorus type, sulfur type and zinc dithiophosphate type anti-wear agents.

In the specimen of the example 7, sulfurized sperm oil was added by the percentage given below as the sulfur type anti-wear agent instead of dibenzyl disulfide (sulfur type) anti-wear agent. The fluid for viscous coupling thus prepared was tested by the same procedure as in the example 7, and viscosity change, torque change and wear fragment iron quantity were measured. The results are shown in the table below.

| Added quantity of phosphorus type (wt %) | Added quantity of sulfur type (wt %) | Viscosity change (%) | Torque change (%) | Wear fragment iron (ppm) |
|---|---|---|---|---|
| 0 | 0.5 | +5 | +7 | 450 |
| 0.25 | 0.25 | +3 | +3 | 200 |

When sulfurized olefin was used instead of sulfurized sperm oil in this example, similar results were obtained.

In the specimen of the example 7, aminedibutyl phosphonate (phosphorus type) anti-wear agent was added by the percentage given below instead of tricresyl phosphate (phosphorus type) anti-wear agent. The fluid for viscous coupling thus prepared was tested by the same procedure as in the example 7, and viscosity change, torque change and wear fragment iron quantity were measured. The results are given in the table below.

In the table, the results of the case where sulfur type was not added are also shown.

| Added quantity of phosphorus type (wt %) | Added quantity of sulfur type (wt %) | Viscosity change (%) | Torque change (%) | Wear fragment iron (ppm) |
|---|---|---|---|---|
| 0.5 | 0 | +7 | +5 | 450 |
| 0.25 | 0.25 | +1 | +1 | 200 |

EXAMPLE 10

In the specimen of the example 7, di-sec-butyl zinc dithiophosphate (zinc dithiophosphate type) was added by the percentage given below instead of dibenzyl disulfide (sulfur type). The fluid for viscous coupling thus prepared was tested by the same procedure as in the example 7, and viscosity change, torque change and wear fragment iron quantity were measured. The results are shown in the table below.

In the table, the results of the case where phosphorus type was not added are also shown.

| Added quantity of phosphorus type (wt %) | Added quantity of zinc thiophosphate (wt %) | Viscosity change (%) | Torque change (%) | Wear fragment iron (ppm) |
|---|---|---|---|---|
| 0 | 0.5 | +8 | +7 | 350 |
| 0.25 | 0.25 | +3 | +3 | 250 |

In the specimen of the example 7, triphenyl phosphorothionate (phosphorus type) anti-wear agent was added by the percentage as given below instead of tricresyl phosphate (phosphorus type) anti-wear agent. The fluid for viscous coupling thus prepared was tested by the same procedure as in the example 7, and viscosity change, torque change and wear fragment iron quantity were measured. The results are shown in the table below.

In the table, the results of the case where sulfur type agent was not added are also shown as the comparative sample.

| Added quantity of phosphorus type (wt %) | Added quantity of sulfur type (wt %) | Viscosity change (%) | Torque change (%) | Wear fragment iron (ppm) |
|---|---|---|---|---|
| 0.5 | 0 | +5 | +3 | 350 |
| 0.25 | 0.25 | +1 | 0 | 130 |

To dimethylsilicone (viscosity 50,000 $mm^2/s$, 25° C.), phenyl-α-naphthylamine was added by 0.5 wt % as antioxidant and benzothiazole was added as metal deactivator, and triphenyl phosphate was added as anti-wear agent by the percentages as given below. The fluid for viscous coupling thus prepared was filled into a viscous coupling having 111 disks at 25° C. and with the filling degree of 85 vol %. The rotating speed difference was 50 rpm.

The viscous coupling was placed in a bath kept at constant temperature of 130° C. and was operated for 100 hours. After the operation, viscosity change and torque change were measured. The results are given in the table below.

| Anti-wear agent (wt %) | Metal deactivator (wt %) | Viscosity change (%) | Torque change (%) |
|---|---|---|---|
| 0 | 0 | Measurement not achievable* | Measurement not achievable* |
| 0 | 0.1 | +10 | +10 |
| 0 | 0.4 | +8 | +7 |
| 0 | 0.8 | +5 | +5 |
| 0.5 | 0.1 | +2 | +2 |

*Stopped before the expiration of 100 hours due to sudden increase of torque.

To dimethylsilicone (viscosity 50,000 $mm^2/s$, 25° C.), diphenylamine was added in an amount of 1.0 wt % as antioxidant, benzotriazole was added as metal deactivator, and tricresyl phosphate was added as anti-wear agent by the percentage as given below. The fluid for viscous coupling thus prepared was filled into a viscous coupling having 111 disks at 25° C. and with the filling degree of 85 vol %. The rotating speed difference was 50 rpm.

The viscous coupling was placed in a bath kept at constant temperature of 130° C. and was operated for 100 hours.

After the operation, viscosity change and torque change were measured. The results are given in the table below. In the table, the results of the case where metal deactivator was not added are also shown.

| Anti-wear agent (wt %) | Metal deactivator (wt %) | Viscosity change (%) | Torque change (%) |
|---|---|---|---|
| 0 | 0 | Measurement not achievable* | Measurement not achievable* |
| 0 | 0.1 | +8 | +8 |
| 0 | 0.4 | +5 | +5 |
| 0 | 0.8 | +3 | +3 |
| 0.5 | 0.1 | ±0 | ±0 |

*Measurement stopped before the expiration of 100 hours due to sudden increase of torque.

In this example, the fluid for viscous coupling was prepared without adding antioxidant, and viscosity change and torque change were measured. The results are shown in the table below.

| Anti-wear agent (wt %) | Metal deactivator (wt %) | Viscosity change (%) | Torque change (%) |
|---|---|---|---|
| 0 | 0 | measurement not achievable | Measurement not achievable |
| 0 | 0.1 | +10 | +10 |
| 0 | 0.4 | +7 | +5 |
| 0 | 0.8 | +5 | +4 |
| 0.5 | 0.1 | +2 | ±0 |

In each specimen in the example 13, a corrosion inhibitor n-octadecyl ammonium stearate was added by the percentage given below instead of metal deactivator. The fluid for viscous coupling thus prepared was tested by the same procedure as in the example 13, and viscosity change and torque change were measured. The results are shown in the table below. In the table, the added quantity of the anti-wear agent was not given.

| Added quantity of corrosion inhibitor (wt %) | Viscosity change (%) | Torque change (%) |
|---|---|---|
| 0 | Measurement not achievable | Measurement not achievable |
| 0.1 | +12 | +12 |
| 0.4 | +8 | +10 |
| 0.8 | +4 | +5 |
| 0.1 | +3 | +3 |

In this example, the fluid for viscous coupling was prepared without adding antioxidant, and viscosity change and torque change were measured. The results are shown in the table below.

| Corrosion inhibitor (wt %) | Viscosity change (%) | Torque change (%) |
|---|---|---|
| 0 | Measurement not achievable | Measurement not achievable |
| 0.1 | +14 | +14 |
| 0.4 | +10 | +10 |
| 0.8 | +5 | +6 |
| 0.1 | +3 | +3 |

In the above example 13, the metal deactivator was added in an amount of 0.1 wt. % and the corrosion inhibitor was added by 0.2 wt %. The fluid for viscous coupling thus prepared was tested by the same procedure as in the example 13, and viscosity change and torque change were measured. As the result, viscosity change was ±0%, and torque change was +3%.

What we claim is:

1. A fluid for viscous coupling, consisting essentially of:

an organopolysiloxane having a viscosity of from 1,000 to 500,000 $mm^2/s$ (25° C.) represented by the formula:

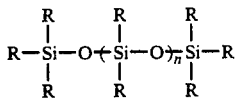

where R of said organopolysiloxane represents a hydrocarbon group have 1 to 18 carbon atoms and may be the same or different, and may be halogenated, an n represents an integer of 130 to 1,500; and at least 0.01 to 5 weight %, based on said polyorganosiloxane, of one or more types of substances selected from the following groups:

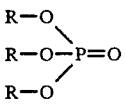
(1)

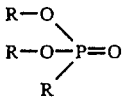
(2)

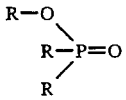
(3)

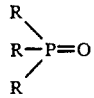
(4)

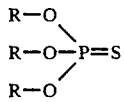
(5)

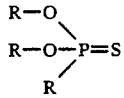
(6)

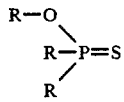
(7)

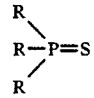
(8)

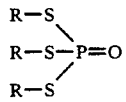
(9)

-continued (10)

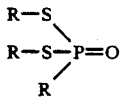

(11)

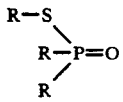

(12)

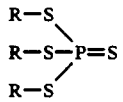

(13)

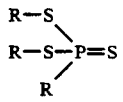

(14)

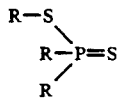

(15)

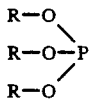

(16)

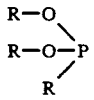

(17)

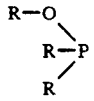

(18)

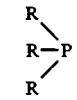

(19)

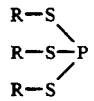

(20)

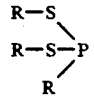

(21)

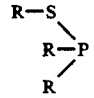

(22)

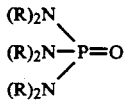

(23)

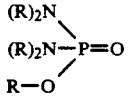

-continued (24)

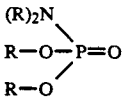

(25)

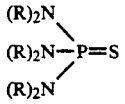

(26)

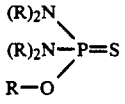

(27)

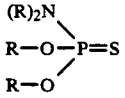

(28)

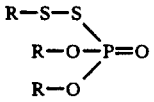

(29)

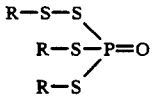

(30)

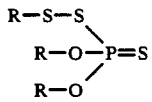

(31)

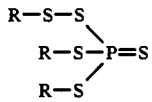

where R of said groups represents hydrogen, alkyl group, aryl group or benzyl group, and may be the same or different; and up to 5 wt. % of an antioxidant based on the organopolysiloxane.

2. A fluid for viscous coupling according to claim 1, wherein 0.001 to 5 wt. % of the antioxidant is present.

3. A fluid for viscous coupling according to claim 1, wherein the anti-wear agent further comprises at least one of a sulfur-containing anti-wear agent and a zinc dithiophosphate-containing anti-wear agent, the amount of phosphorus-containing anti-wear agent to total anti-wear agent being from 5–95 wt. %, said sulfur-containing anti-wear agent being selected from the group consisting of sulfides, sulfurized oil, and thiocarbonates.

4. A fluid for viscous coupling according to claim 3, wherein, 0.001 to 5 wt. % of the antioxidant is present.

5. A fluid for viscous coupling, consisting essentially of:

an organopolysiloxane having a viscosity of from 1,000 to 500,000 $mm^2/s$ (25° C.) expressed by the formula:

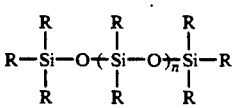

where R of said organopolysiloxane represents a hydrocarbon group have 1 to 18 carbon atoms and may be the same or different, and may be halogenated, an n represents an integer of 130 to 1,500;
up to 5 wt. % of an antioxidant based on the organopolysiloxane;
at least 0.01 to 5 wt. % of an anti-wear agent based on the organopolysiloxane, selected from the following groups:
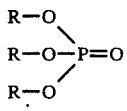
(1)
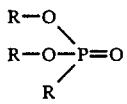
(2)
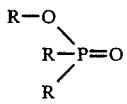
(3)
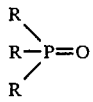
(4)
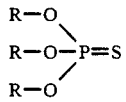
(5)
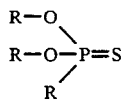
(6)
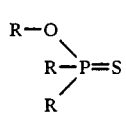
(7)
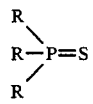
(8)
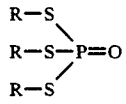
(9)
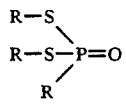
(10)
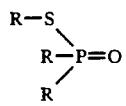
(11)
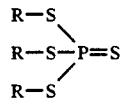
(12)
-continued
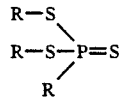
(13)
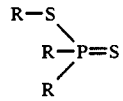
(14)
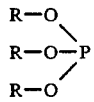
(15)
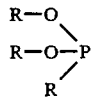
(16)
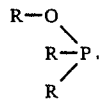
(17)
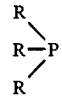
(18)
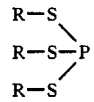
(19)
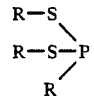
(20)
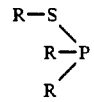
(21)
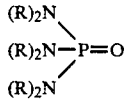
(22)
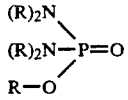
(23)
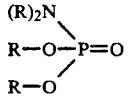
(24)
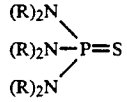
(25)
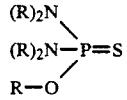
(26)

-continued (27)

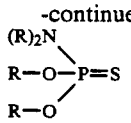

(28)

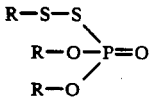

(29)

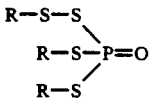

(30)

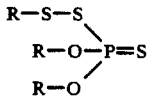

(31)

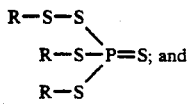

; and 0.001 to 1.0 weight %, based on said organopolysiloxane, of at least one of a metal deactivator and a corrosion inhibitor, said metal deactivator being at least one type selected from the group consisting of dibasic acids, and monobasic acids;

said dibasic acids being selected from the group consisting of benzotriazole, benzotriazole derivative, thiadiazole, thiadiazole derivative, triazole, triazole derivative, dithiocarbamate, dithocarbamate derivative, indazole, indazole derivative, adipic acid, sebacic acid, and dodecane diacid; and said monobasic acid being selected from the group consisting of stearic acid, oleic acid, and lauric acid, and amine salts of these substances; and said corrosion inhibitor being at least one type selected from the group consisting of isosterate, n-octadecylammonium stearate, duomin-T dioleate, lead naphthenate, sorbitan oleate, pentaerythrit oleate, oleyl sarcosine, alkyl succinic acid, alkenyl succinic acid and derivatives of these substances.

6. A fluid for viscous coupling according to claim 5, wherein from about 0.001 to 5 wt. % of the antioxidant is present.

7. A fluid for viscous coupling according to claim 5, wherein from about 0.001 to 5 wt. % of the antioxidant is present.

* * * * *